United States Patent [19]

Kopachkov

[11] 4,037,804

[45] July 26, 1977

[54] LOCKING MECHANISM

[75] Inventor: Slavco A. Kopachkov, Toronto, Canada

[73] Assignee: Rothmans of Pall Mall Canada Limited, Toronto, Canada

[21] Appl. No.: 698,950

[22] Filed: June 23, 1976

[51] Int. Cl.[2] ..... B65H 17/02

[52] U.S. Cl. ..... 242/68.3

[58] Field of Search ..... 242/68.3, 72, 75.8, 242/46.2, 46.4

[56] References Cited

U.S. PATENT DOCUMENTS

| | | | |
|---|---|---|---|
| 2,638,283 | 5/1953 | Bebech | 242/72 |
| 2,659,542 | 11/1953 | Steuber | 242/68.3 |
| 3,313,496 | 4/1967 | Northrup | 242/68.3 |
| 3,811,638 | 5/1974 | Bruns | 242/72 |

*Primary Examiner*—Edward J. McCarthy
*Attorney, Agent, or Firm*—Sim & McBurney

[57] ABSTRACT

A locking mechanism for releasably mounting a reel of material on a hub includes a sun gear wheel mounted on an axial shaft and three planetary gear wheels meshing with the sun gear wheel and mounted on shafts rotatable about axes parallel to the axial shaft. Cylindrical gripping members are eccentrically mounted on the latter shafts for projection and retraction from the hub surface on actuation of the mechanism.

6 Claims, 3 Drawing Figures

LOCKING MECHANISM

FIELD OF INVENTION

This invention relates to a locking mechanism for releasably locking a reel to a hub for rotation of the reel on the hub.

SUMMARY OF INVENTION

The present invention provides a locking mechanism comprising a hollow cylindrical housing having a circular base plate, wall means upstanding from and integral with the base plate and a circular cover plate closing the open end of the housing. An axle extends through the base plate axially of the housing and into the housing in non-rotatable relationship therewith.

A gear wheel is mounted on the axle within the housing for rotation therewith. Three planetary gears are located within the housing and are arranged in planetary fashion about the sun gear wheel in enmeshed relationship therewith. The planetary gear wheels are substantially equally orbitally spaced from one another.

Elongate axles are mounted within the housing in rotatable relationship therewith and extend between the base plate and cover plate in parallel relationship to each other and the axis of the housing. Each of the axles has one of the planetary gear wheels mounted thereon in non-rotatable relationship therewith. Three circumferentially-spaced axial slots are formed in the wall means and are arranged in radial alignment with the elongate axles.

At least one cylindrical gripping member is eccentrically mounted on each of the elongate axles for rotation therewith between a first position in which each of the gripping members is simultaneously positioned wholly within the periphery of the wall means and a second position in which a portion of each of the gripping members simultaneously projects through the adjacent one of the slots and outside the periphery of the wall means.

Actuation means is associated with one of the elongate axles for rotation of the same to cause simultaneous rotation of all the elongate axles and simultaneous movement of the gripping members between the first and second positions thereof.

DESCRIPTION OF PREFERRED EMBODIMENT

Figure 2:
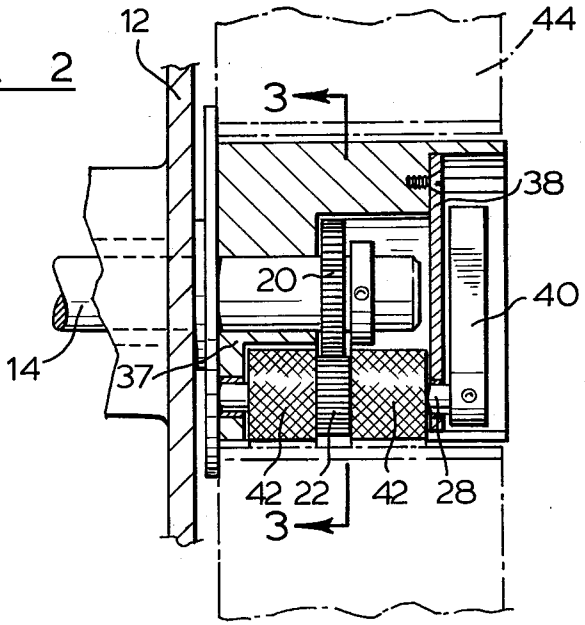
FIG. 2 is a section taken on line 2—2 of FIG. 1 of the locking mechanism in assembled form.
Figure 3:
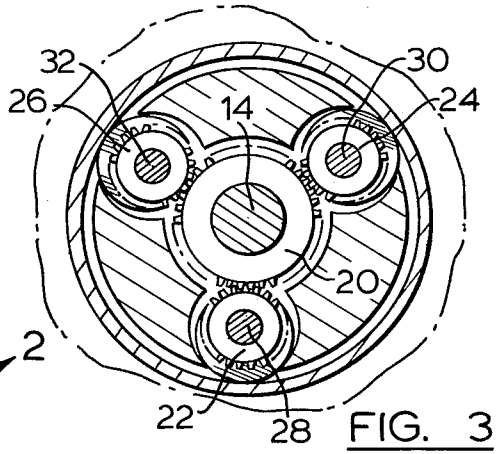
FIG. 3 is a section taken on line 3—3 of FIG. 2.
Figure 1:
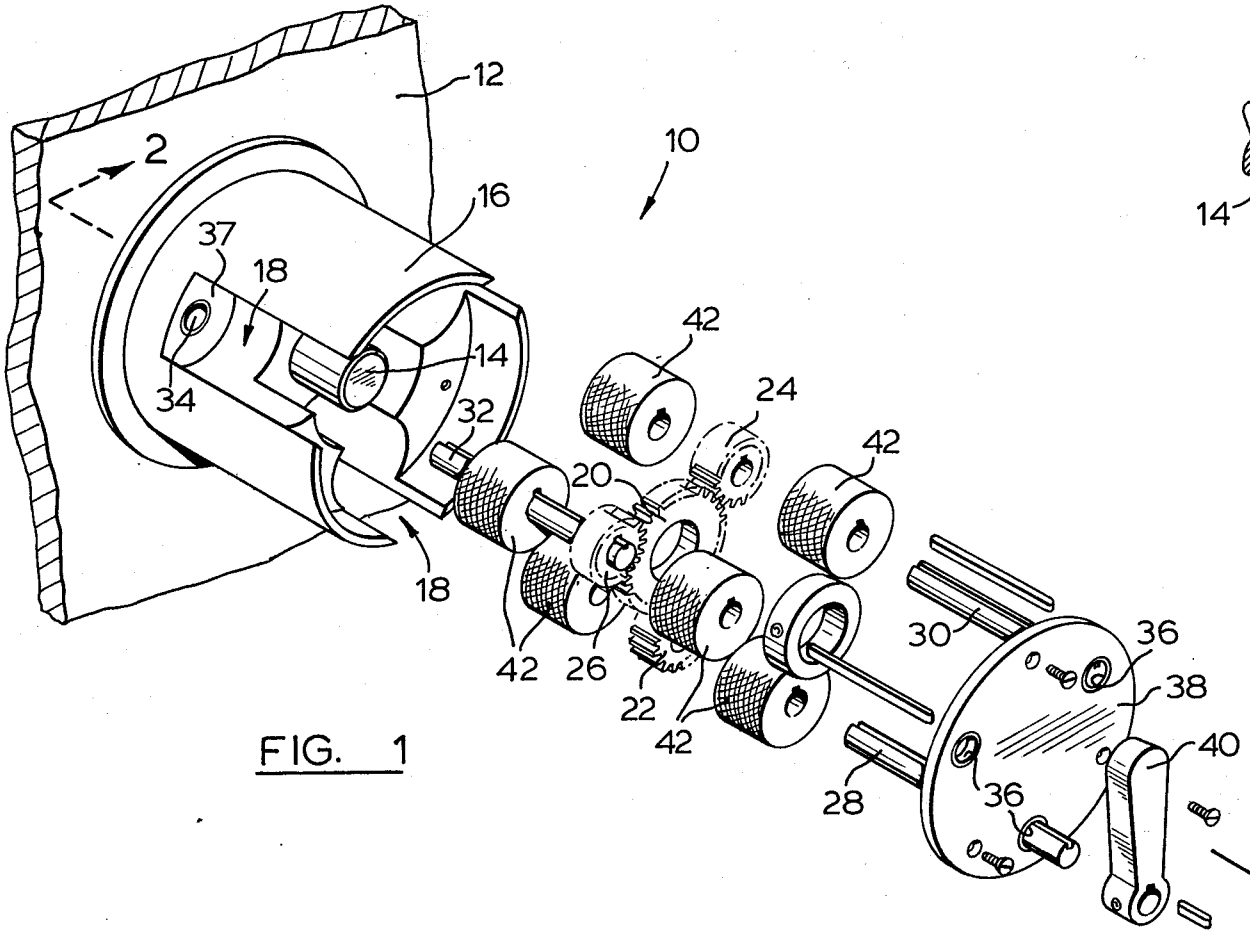
FIG. 1 is an exploded perspective view of a locking mechanism according to this invention.

A releasable locking mechanism 10 comprises a stationary wall support member 12, an axle 14 extending through the stationary wall member in rotatable relation with reference thereto. A hollow cylindrical body member 16 is fixedly mounted to the axle 14 for rotation therewith about the axis thereof. The body member 16 has three axial openings 18 equidistantly circumferentially spaced from each other.

A sun gear wheel 20 is interference fit mounted to the axle 14 for rotation therewith at approximately the mid-point of the length of the body member 16. Three planet gear wheels 22, 24 and 26 intermesh with the sun gear wheel 20 and each is fixedly mounted to a rod 28, 30 and 32. Each rod 28, 30 and 32 extends axially of the cylindrical body member 16 in radial alignment with one of the openings 18. Each of rods 28, 30 and 32 is mounted in orifices 34 and 36 in a base 37 of the body member 16 and a disc-like cover member 38 respectively for rotation in the body member 16, with rod 28 projecting through the cover member 38. An actuating lever 40 is fixedly mounted to the projection of the rod 28.

Eccentrically fixedly mounted on each of the rotatable rods 28, 30 and 32 one each side of the respective planet gear wheel 22, 24 and 26 is a pair of metal cylinders 42.

Movement of the lever 40 in one direction causes rotation of all the pins 28, 30 and 32 through the intermeshing of the planetary gear wheels 22, 24 and 26 and the sun gear wheel 20. Upon such rotation, the eccentricity of each member of the pairs of metal cylinders 42 results either in projection of the metal cylinders through the respective slot 18 as the lever 40 is moved in one direction or in positioning the metal cylinders wholly within the diameter of the body member 16 as the lever 40 is moved in the other direction.

The locking mechanism 10 may be used to releasably mount a reel of material thereto, shown schematically at 44, for rotation therewith upon rotation of the axle 14. Where the metal cylinders extend through the slots 18, the reel 44 is locked to the mechanism 10 while movement of the lever 40 in the appropriate direction allows release of the reel 44 from the mechanism 10 as the metal cylinders 42 retract through the slots 18.

The mechanism 10 has particular utility for releasably mounting reels of foil-backed paper for mentholation, as described in copending application Ser. No. 684,196 filed May 7, 1976.

SUMMARY

The present invention, therefore, provides a releasable mounting mechanism which is simple in operation but which is very effective. Modifications are possible within the scope of the invention.

What I claim is:

1. A locking mechanism comprising:

a hollow cylindrical housing having a circular base plate, wall means upstanding from and integral with said base plate and a circular cover plate closing an open end of said housing, an axle extending through said base plate axially of and into said housing in non-rotatable relationship therewith, sun gear wheel means mounted on said axle within said housing for rotation therewith, three planetary gear wheel means located within said housing, said planetary gear wheel means being arranged in planetary fashion about and enmeshed with said sun gear wheel means, said planetary gear wheel means being substantially equally orbitally spaced one from another, elongate axles mounted within the housing in rotatable relationship therewith and extending between said base plate and said cover plate in parallel relationship to each other and the axis of said housing, each of said axles having one of said planetary gear wheel means mounted thereon in non-rotatable relationship therewith, three circumferentially spaced axial slots formed in said wall means and arranged in radial alignment with said elongate axles, at least one cylindrical gripping member eccentrically mounted on each of said elongate axles for rotation therewith between a first position in which each of said gripping members is simultaneously positioned wholly within the periphery of said wall means and a second position in which a portion of each of said gripping members simultaneously projects through the adjacent one of said slots and outside said periphery of said wall means, and actuation means associated with one of said elongate axles for rotation of the same to cause simultaneous rotation of all said elongate axles and simultaneous movement of said gripping members between said first and second positions thereof.

2. The locking mechanism of claim 1, wherein said gear wheel means and planetary gear wheel means are located at the approximate mid-point of the axial length of said housing.

3. The locking mechanism of claim 1, wherein there are two of said cylindrical gripping members mounted one on each axial side of the respective planetary gear wheel means.

4. The locking mechanism of claim 3 wherein said cylindrical gripping members are constructed of metal.

5. The locking mechanism of claim 1 wherein said actuation means is a lever arm connected to an end of said one of said axles projecting through said cover plate and extending generally parallel to said cover plate.

6. The locking mechanism of claim 1, wherein said gear wheel means and planetary gear wheel means are located at the approximate mid-point of the axial length of said housing, there are two of said cylindrical gripping members mounted one on each axial side of the respective planetary gear wheel means, and said actuation means is a lever arm connected to an end of one of said axles projecting through said cover plate and extending generally parallel to said cover plate.

* * * * *